United States Patent [19]

Pollock

[11] 3,979,871

[45] Sept. 14, 1976

[54] MODULAR FLOOR STRUCTURE

[76] Inventor: Eugene B. Pollock, 116 N. Mary St., Assumption, Ill. 62510

[22] Filed: Dec. 5, 1974

[21] Appl. No.: 529,962

[52] U.S. Cl. ..... 52/270; 220/5 A; 52/664; 52/247; 52/608

[51] Int. Cl.[2] ..... E04B 5/02; E04B 1/08; E04C 2/08

[58] Field of Search ..... 110/1 C; 52/270, 263, 52/415, 608, 247, 249, 604, 475, 245–248, 82, 595, 81, 237, 753 T, 265, 264, 192–196, 664, 665, 726, 457, 458; 165/9.4; 113/120 R; 220/5 A

[56] References Cited

UNITED STATES PATENTS

| | | | |
|---|---|---|---|
| 1,983,017 | 12/1934 | Bowland | 165/9.4 |
| 2,222,137 | 11/1940 | Bruce | 52/595 |
| 2,453,326 | 11/1948 | Lambert | 52/753 T |
| 2,493,470 | 1/1950 | Tau | 52/604 |
| 3,426,445 | 2/1969 | Steffen | 52/247 |
| 3,514,913 | 2/1970 | Nelson | 52/415 |
| 3,591,994 | 7/1971 | Steffen | 52/263 |

FOREIGN PATENTS OR APPLICATIONS

| | | | |
|---|---|---|---|
| 201,032 | 2/1956 | Australia | 52/237 |
| 1,017,902 | 10/1952 | France | 52/237 |

*Primary Examiner*—James L. Ridgill, Jr.
*Attorney, Agent, or Firm*—Wegner, Stellman, McCord, Wiles & Wood

[57] ABSTRACT

A modular floor structure of modular components for use in a building, such as a grain storage bin or the like, in which a plurality of floor sections are formed of planar material with there being a number of different perimetric contours for various ones of said floor sections including a basic section providing, by interconnection therebetween, a major part of the floor area. The floor sections are supported above the ground or other surface by support members positionable beneath overlapped parts of adjacent floor sections and the support members as well as floor sections have structure permitting insertion of fastening devices to lock said floor sections to each other and to the subjacent support member.

14 Claims, 17 Drawing Figures

Fig. 9.
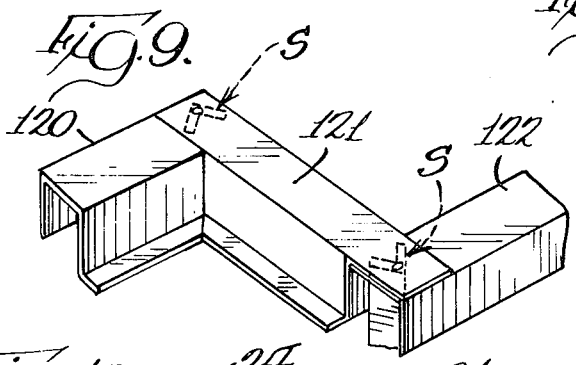
Fig. 8.
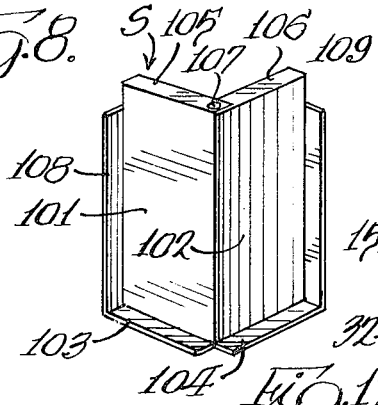
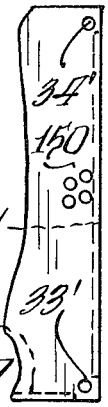
Fig. 17.
Fig. 10.
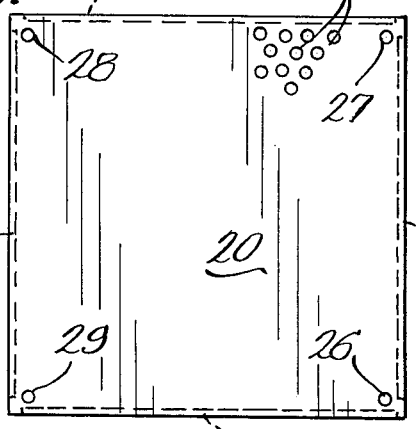
Fig. 11.
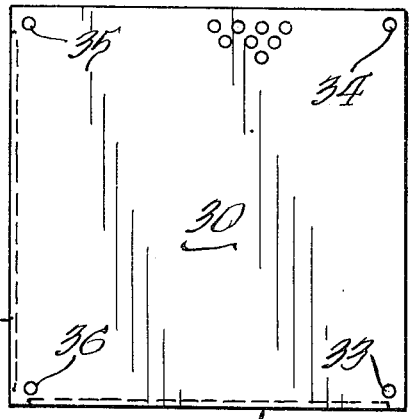
Fig. 12.
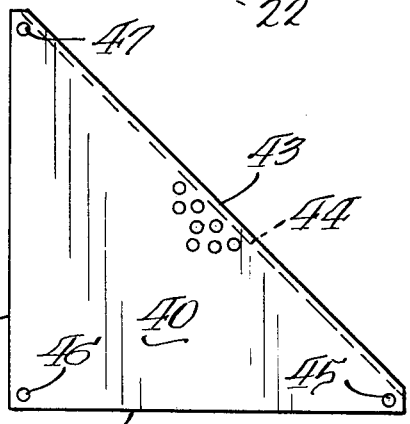
Fig. 13.
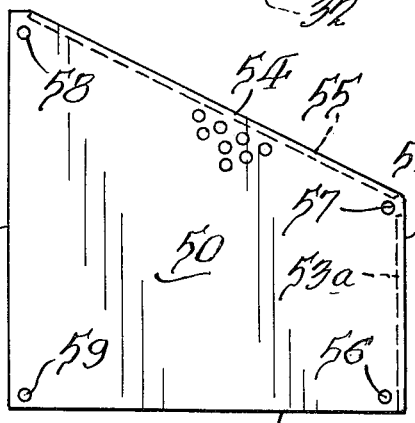
Fig. 14.
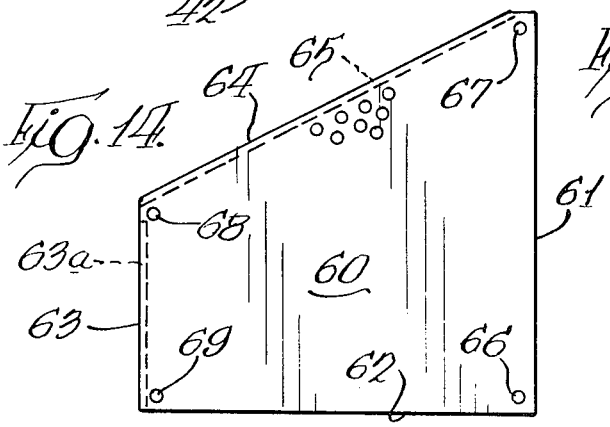
Fig. 15.
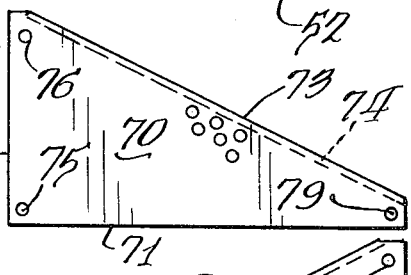
Fig. 16.
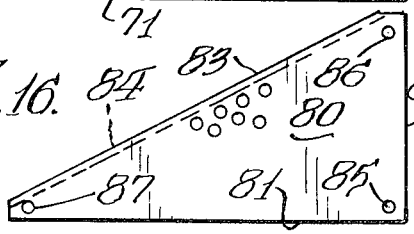

MODULAR FLOOR STRUCTURE

BACKGROUND OF THE INVENTION

This invention pertains to floor structures formed of modular components for use in either portable or permanent buildings, primarily which are of a round construction, such as a grain storage bin or the like.

Many different floor structures have been used for buildings of the type to which this invention relates and, in some instances, prefabricated sections can be assembled at the site. Examples of such floor constructions are shown in the Steffen U.S. Pat. Nos. 2,818,009, 3,408,747, 3,512,322, and 3,591,994. The prior art has not disclosed a floor structure having a limited number of modular units of varying perimetric contour which can be stocked and selected in the right numbers and variations for providing floors of varying area depending upon the diameter of the building with which the floor structure is associated.

SUMMARY OF THE INVENTION

A distinctive feature of the invention disclosed herein resides in a modular floor structure made up of modular floor sections with there being a multiplicity of floor sections having different perimetric contours including a basic floor section of a square shape and which can be interconnected with other additional basic sections in multiples adequate to provide the major area of the floor and with other floor sections of different perimetric contours being added to said basic floor sections at portions of the periphery of the floor to, in effect, round out the configuration of the floor into close approximation with the contour of the building. In the floor structure, the use of additional basic sections increases the floor structure by a modular amount corresponding to a modular increase in diameter of the building and with the additional floor sections of differing perimetric contours being usable in different combinations, dependent upon the diameter of the floor to obtain the rounding-out of the floor structure.

In the invention, the floor sections are all provided with similarly-located means defining openings whereby adjacent floor sections can overlap to have locking means inserted through the openings for rigidifying the floor structure by securing adjacent floor sections together. Additionally, simply constructed support members are positioned beneath the overlapped parts of adjacent floor sections to provide ground support for the floor structure and receiving means for the locking means passed through the overlapped floor sections to interconnect the floor sections to the subjacent support member.

The support member is constructed of a pair of angularly-related planar sections, with laterally-extending flanges at the lower ends thereof to form a ground-engaging foot for the support member and with additional flanges at the opposite upper ends of said panels being provided for strengthening of the support member and being overlapped with an opening therethrough to receive the locking means which secures the floor structure to the support members.

Alternative to use of individual support members, a plurality of such support members may be prefabricated with associated channel members and in assembly of the floor structure, one of the prefabricated support assemblies positioned beneath the floor sections for support of the floor and interconnection with the floor sections disposed thereabove.

In development of the modular floor section, consideration has been given to a range of building diameters with which the floor structure would normally be used. These diameters are in the practical range of 15–48 feet, but can be substantially larger and examples of the assembly of the floor structure for certain of these various diameters are given in the drawings. It has been found that the range of diameters can be accommodated by a limited number of modular components, including a basic square section with all four edges of a modular length, a second section with three-fourths of the area of the basic section, a third section with one-half the area of the basic section, and a fourth section with one-fourth the area of the basic section. The second, third and fourth sections all have a right angle corner with an opposite edge inclined with respect to the adjacent edges. In assembly, the opposite inclined edge lies at the perimeter of the floor structure and has a depending strengthening flange to provide added floor strength.

With the four basic sections, as set forth in the preceding paragraph, and with a least two of said sections also having similar sections which are a mirror image thereof, it is possible to provide for a large range of floor sizes for a large range of round buildings with a limited number of basic section shapes being required and, therefore, an inventory of this limited number of floor sections enhances the economical use of this modular floor structure.

BRIEF DESCRIPTION OF THE DRAWING

FIG. 8 is a perspective, elevational view of a support member embodying the invention;

FIG. 9 is a perspective view of an alternate form of support member embodying a plurality of elements prefabricated together;

FIG. 10 is a plan view of the basic floor section used as a center element of the floor;

FIG. 11 is a plan view of the basic floor section used other than as the center section;

FIG. 12 is a plan view of a floor section having a contour different than the basic section;

FIG. 13 is a plan view of a third floor section having a contour different from that of the preceding FIGS. 10 to 12.

FIG. 14 is a plan view of the floor section corresponding to FIG. 13, but being a mirror image thereof;

FIG. 15 is a plan view of another floor section; and

FIG. 16 is a plan view of an additional floor section which is of the same construction as that shown in FIG. 15, but being a mirror image thereof, and FIG. 17 is a plan view of a modified basic floor section.

DESCRIPTION OF THE PREFERRED EMBODIMENT

Figure 1:
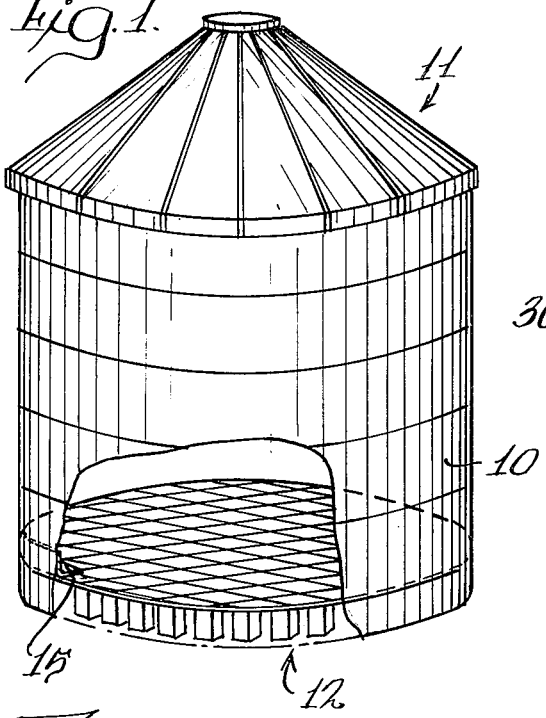
FIG. 1 is a perspective elevational view of a round building, such as a grain storage bin, and with a part of the exterior wall broken away to show the floor structure.

A round building of the type with which the floor structure embodying the invention is utilized is shown generally in FIG. 1 and may be either portable or permanent with a series of vertically-stacked, curved wall panels 10 extending to ground level and covered by a roof structure, indicated generally at 11. This type of building is used for grain storage and includes a perforate floor to facilitate circulation therethrough. The floor structure is indicated generally at 12 and is substantially round in plan and of a diameter closely approximating the interior diameter of the building. The space between the perimeter of the floor structure 12 and the interior of the building wall 10 is covered by an L-shaped flashing 15 fastened to the wall of the building and extending outwardly over the perimeter of the floor structure a sufficient distance to cover any gaps therebetween.

The floor structure 12 is of a modular construction involving the use of a limited number of planar floor sections of perforate material which can be assembled in various relations to provide floors of different diameters and corresponding to the building diameter. A primary floor section used as a center section is shown in FIG. 10 wherein a planar sheet of material 20 is perforate, as indicated at 21, with a limited number of perforations being shown but it being understood that there can be perforations throughout the entire sheet of material. A suitable material is a relatively lightweight metal because of the strengthening flanges and support structure therefor, as more fully described hereinafter. The basic section has a square shape to provide a perimetric contour with four edges of the basic modular length and with each of these edges having a downturned strengthening flange 22, 23, 24, 25 extending along the associated edge.

The basic center section 20 is provided with a series of openings 26, 27, 28 and 29 therethrough and located one at each corner thereof for securement of the section to adjacent floor sections as well as to support structure described hereinafter.

The same basic section is illustrated in FIG. 11 and is the primary floor section 30, with the section 20 of FIG. 10 being a center section for the floor. The basic section 30 has only a pair of depending strengthening flanges 31 and 32 extending along two edges thereof whereby the basic section 30 may slightly overlap the basic section 20 in assembly of the floor structure.

The basic section 30 has four openings 33, 34, 35, and 36 therethrough and positioned one at each of the four corners thereof for alignment with openings in adjacent floor sections to facilitate securing of the floor sections together as well as to support structure therebeneath. In securing the basic section 30 to the center basic section 20, the basic section 30 is oriented relative thereto whereby the depending strengthening flanges 31 and 32 thereof are remote from the center basic section 20. The basic section 30 is placed in a slight overlapped relation with the center section 20 and two of the openings 26–29 of the center section 20 are then in alignment with any two of the three openings 33–35 of the basic section 30.

An additional floor section is shown in FIG. 12 and is a section having half the area of the basic section. This section 40 is formed from similar perforate planar material and has edges 41 and 42 forming base legs of a right angle corner and with the opposite edge 43 being inclined relative to the intersecting edges. The opposite edge 43 has a depending strengthening flange 44. Additionally, there are fastening openings 45, 46, and 47 located at the three corners of this triangular floor section for overlap and alignment with an adjacent floor section.

An additional floor section is shown in FIG. 13 wherein a section 50 of similar perforate planar material is formed with sides 51 and 52 of the modular length and with a side 53 of one-half the modular length and having a strengthening flange 53*a*. A fourth side 54 is inclined and has a depending strengthening flange 55. This floor section 50 has an area approximating three-quarters of the area of the basic floor section. This section 50 also has four openings 56, 57, 58, and 59 for alignment with openings of other floor sections for attachment with adjacent floor sections in overlapped relation.

FIG. 14 illustrates a floor section 60 which is a mirror image of the floor section 50 and which has edges 61 and 62 of the modular length, with an edge 63 having an edge which is approximately one-half of the modular length and having a strengthening flange 63*a*. A fourth inclined edge 64 has a depending strengthening flange 65. There are fastening openings 66, 67, 68 and 69 located at the four corners of the floor section.

FIG. 15 illustrates a further floor section 70 of a different perimetric contour having an edge 71 of the basic modular length, a second edge 72 at right angles to the first edge and an inclined edge 73 having a depending strengthening flange 74. This floor section is also triangular whereby the base legs 71 and 72 have an opposite inclined edge 73 and with the edge 72 having the same length as the edge 53 of the floor section 50 and the edge 63 of the floor section 60 whereby this edge may overlap therewith and be of the same length. The floor section 70 has openings 75, 76 and 77 at the corners thereof for alignment with openings of other floor sections to facilitate attachment thereto.

A floor section 80 is illustrated in FIG. 16 and is a mirror image of the floor section 70. The floor section 80 is formed from the same perforate planar material and has edges 81 and 82 defining base legs of a triangular configuration and with an opposite inclined edge 83 having a depending strengthening flange 84. There are openings 85, 86, 87, provided at the corners of this floor section for alignment with openings in an overlapped floor section.

The important dimensional relation common to the floor sections is the uniform distance between pairs of alignment openings except for sections 50, 60, 70 and 80 wherein there is a lesser distance between certain openings and with openings 56 and 57 always coacting with a pair of openings 75 and 76, for example.

Figure 2:
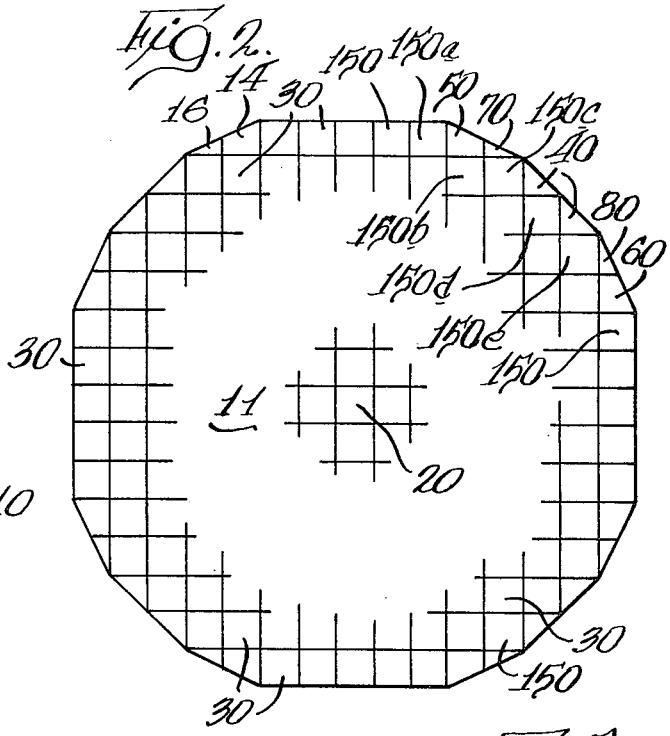
FIG. 2 is a diagrammatic view of the modular floor structure for a particular diameter of building.

A diagrammatic view of a complete floor structure for use with a building of a particular diameter is shown in FIG. 2. Although the actual dimensions may be varied, as an illustrative example with respect to FIG. 2, it may be assumed that the floor structure is to have an approximate 24-foot diameter to fit within a building having an internal diameter of 24 feet. Additionally, the modular length of an edge of the basic section is 18 inches. With these dimensions, a floor structure having a diameter of approximately 24 feet is obtained by the assembly shown in FIG. 2. This assembly is accomplished by use of a basic center section 20 and then attachment thereto of a large number of basic sections 30 to provide the major part of the area of the floor structure. In all quadrants, the orientation of the basic floor section 30 would result in the absence of a depending strengthening flange underlying the adjacent edge of floor sections 40, 50, 60, 70 and 80 and also along the perimeter at certain locations. In order to avoid this potential weakness, a modified basic floor section 150 (FIG. 17) is used. The floor section 150 has the same parts as basic floor section 30 identified by the same reference numeral with a prime affixed thereto. An additional depending strengthening flange 151 extends along a third edge thereof to underlie the adjacent edge of floor sections 40, 50, 60, 70 and 80 and provide perimeter strength. Since the basic sections 30 are square, there are four parts of the floor periphery, as viewed in FIG. 2, which end up with a straight-line configuration. The parts of the floor periphery between these straight-line sections are, in effect, rounded-off by use of several of the floor sections of different perimetric contours. Specifically, a floor section 50 having three-fourths of the area of the basic floor section is fastened to two adjacent modified basic floor sections 150*a* and 150*b*. A floor section 70, having one-fourth the area of the basic section 30, is fastened to the adjacent floor section 50 as well as to the adjacent modified basic floor sections 150*b* and 150*c* and to a corner of a floor section 40 having one-half the area of the basic floor section. This floor section 40 is also fastened to a basic section 30 and modified basic sections 150*c* and 150*d*. Additionally, there is another floor section 40 attached to adjacent floor sections including a modified basic floor section 150*e* and a floor section 80 with the final floor section at this part of the periphery being another floor section 60. The rounding-off contour, as used in four parts of the floor structure shown in FIG. 2, represents a utilization of the entire group of floor sections of different perimetric contours and as illustrated in FIGS. 12–16.

Figure 3:
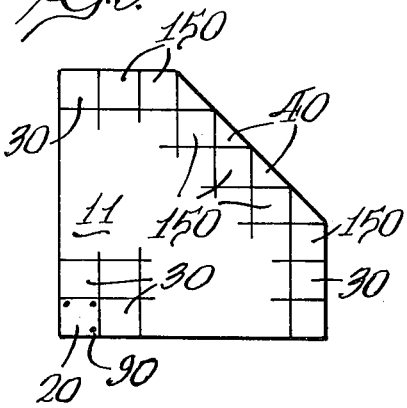
FIG. 3 is a diagrammatic view of approximately one-quarter of a floor structure for a different diameter building.

With the same structural dimensions as given above, a part of the floor structure to provide a floor of a 21-foot diameter is shown in FIG. 3 wherein the rounding-off between basic sections 30 and modified basic floor sections 150 is accomplished with use of four of the triangular sections 40. The flashing 15 has a horizontal flange of a length sufficient to span the gap between straight-line parts of the floor structure and the round interior wall of the building.

Figure 4:
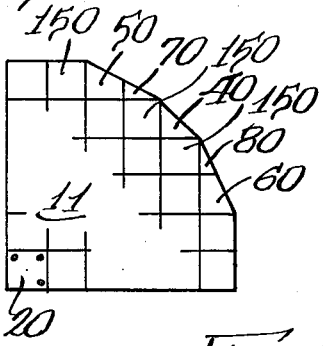
FIG. 4 is a view, similar to FIG. 3, for a third different diameter building.
Figure 5:
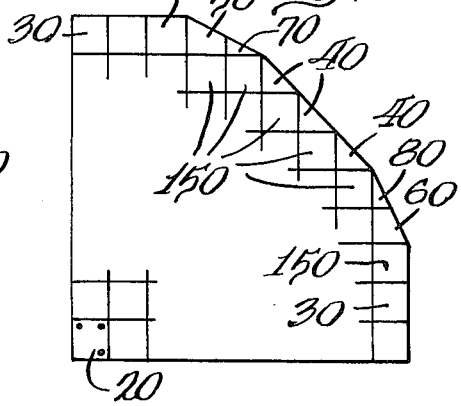
FIG 5 is a view, similar to FIG. 3, showing the assembly of sections for a different diameter building.
Figure 6:
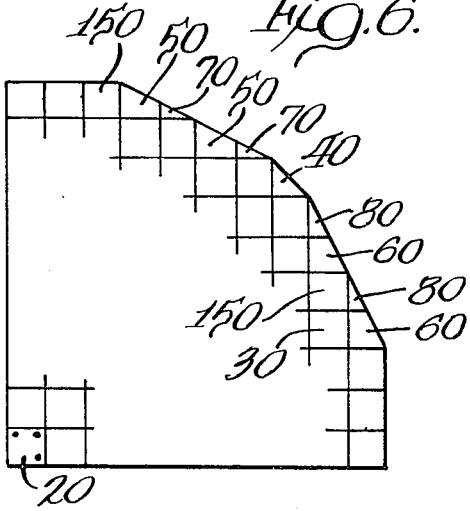
FIG. 6 is a view, similar to FIG. 3, showing an arrangement for yet a different diameter building.
Figure 7:
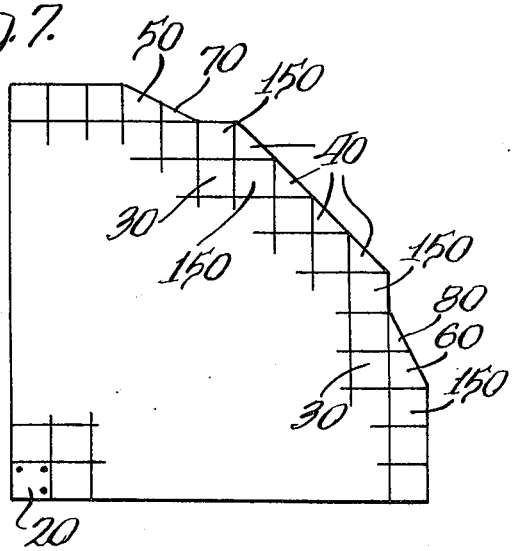
FIG. 7 is a view, similar to FIG. 3, showing an assembly of the floor structure for yet another diameter building.

The method of attaching adjacent floor sections is shown in FIG. 3 wherein the center section 20 has adjacent floor sections 30 with parts thereof overlapping with the center section 20. This results in aligning openings 33 and 34 of basic floor sections 30 with openings 26 and 27, for example, of the center section 20 to receive fastening means 90, such as a self-tapping screw or bolt, which extends into a support member to be described. The assembly of floor sections for an 18-foot diameter floor is shown in FIG. 4 and which involves the use of one of the floor sections 40 in a quadrant of the floor along with a section 50, a section 60, a section 70, and a section 80. It will be understood that in FIGS. 3–7 only one quadrant of the floor structure is shown. In FIG. 5, a larger floor is shown, as for example a 27 foot diameter floor, wherein the major increase in area is accomplished by the use of additional basic sections 30 and with the rounding-off being accomplished by use of additional floor sections 40, 50, 60, and 80. Two floor structures of even larger diameters are shown in FIGS. 6 and 7 and with the structures for accomplishing rounding-off between the straight-line sections being identified.

As stated above, the diameters of floor structures referred to as well as the modular length established for the floor sections is given as illustrative and not as limiting the invention thereto. It will be noted that in all of the configurations of FIGS. 2 through 7, the floor sections at the perimeter all have the depending strengthening flange at the free edge thereof to provide added strength for the floor structure. The planar material from which the floor sections are made is sufficiently thin whereby there can be overlap of two or three floor sections at an intersecting corner wherein the fastening openings are placed in alignment without any substantial distortion to the floor structure.

A basic support member S forming a part of the floor structure is shown in FIG. 8 and which is formed from a single sheet of planar material, such as metal, to have planar sections 101 and 102 at approximate right angles to each other. A pair of laterally-extending flanges 103 and 104 at the base of the planar sections define a foot for ground engagement. A pair of flanges 105 and 106 at the upper ends of the planar sections are in overlapped relation at an end thereof and have an opening 107 therethrough to receive the fastening means 90, such as a self-tapping screw or a bolt threaded into opening 107 whereby adjacent floor sections are fastened to each other and fastened to the subjacent support member. Additional strengthening flanges are provided at 108 and 109 and with these flanges being approximately of the same width as the strengthening flanges for the floor sections 20, 30, 40, 50, 60, 70, and 80. For air circulation, the planar sections 101 and 102 may be slotted.

An alternate form of preassembled support structure is shown in FIG. 9 wherein a pair of the support members S, shown in FIG. 8, are associated with a pair of downwardly open channel members 120 and 121 with the channel member 121 having an end overlapping the channel member 120 and having an opening therethrough to align with the opening 107 in the support member and with the support member being welded thereto. Similarly, a channel member 122 may extend from the opposite end of the channel member 121 and be in overlapped relation therewith and with a support member S welded therebeneath. This permits a prefabricated multiple element support which may include any desired number of channel members and supports S and with each of the channel members being of a length whereby the distance between adjacent support members S is the same as the distance between fastening openings of a floor section 30. In use with the floor sections disclosed herein, it would be necessary to relieve the strengthening flanges of the floor sections to avoid interference with the flanges of the channel members. A primary use of this alternate form of support structure is with previously known type of floors.

With the structure disclosed herein, it is possible to stock a limited number of basic floor sections of different perimetric contours which can be easily assembled to each other and to support members and meet the requirment for providing a floor for many different diameter round buildings.

With the structure of the floor sections and their depending strengthening flanges, it will be seen that all of the floor sections may be assembled in only a certain direction of overlap, starting from overlap of a floor section 30 with the center floor section 20 and that this successive overlap continues radially outward. This is of assistance in either manual or power sweeping of the floor structure since all floor section exposed edges will be facing toward the center.

Additionally, the relation of the depending strengthening flanges of the floor sections controls the orientation of the support members. The support member has the planar sections 101 and 102 at right angles to each other and, therefore, the support member can only be placed beneath an alignment opening of a floor section and against strengthening flanges normal to each other in one particular orientation. This results in support members at opposite sides of center being in opposed relation to contribute to the over-all strength of the floor and have any tendency for tipping of one support member opposed by a similar support member at the opposite side of the center section.

The support members coact with the floor sections to provide automatic spacing of the support members by their orientation to the structure of the floor section and with direct fastening to the floor panels. The individual support members provide a discontinuous support beneath the floor sections whereby passages exist for conveying elements or other structure extended beneath the floor.

As pointed out above, the floor sections have strengthening flanges which, when associated with adjacent floor sections, give substantially continuous strength to the floor and, if desired, the planar parts of the floor sections may be embossed for additional strength.

The floor sections as well as the support member shown in FIG. 8 are all constructed whereby they are stackable for reduced space requirements in storage and transport.

I claim:

1. A floor structure of modular components for use in a building such as a grain storage bin or the like comprising a plurality of floor sections formed of planar material with there being a multiplicity of floor sections having different perimetric contours including a basic square floor section with all four edges of a modular length for assembly in overlapped relation to provide a major part of the floor surface and additional floor sections of a lesser area than the basic floor section and of differing contours with respect to each other and with each having at least one edge of said modular length for placement at the perimeter of the floor and with said one edge adjacent and overlapped with an edge of a basic floor section, support members for said floor sections positionable beneath overlapped parts of adjacent floor sections, and means defining aligned openings in said overlapped floor sections and a subjacent support member, and means extended through said openings to lock said floor sections to said support member, each of said support members comprising a pair of integral panels angularly related to each other and with a plurality of strengthening flanges extended therefrom, certain of said strengthening flanges extending at right angles from said panels to define a ground-engaging foot, and additional flanges at the opposite ends of said panels being overlapped and having said opening to receive said locking means.

2. A floor structure as defined in claim 1 wherein said additional floor sections include a first triangular contour being one-half the area of the basic section and with the two base legs thereof of the modular length, a second triangular contour being one-fourth the area of the basic section with one base leg of the modular length, and an additional contour which is three-fourths the area of the basic section and has two perimetric edges of the modular length.

3. A floor structure as defined in claim 1 wherein said basic floor section has a center member used at the floor center with a lock-receiving opening at each corner and a depending strengthening flange along each of its four edges, the remainder of the basic floor sections having the depending strengthening flanges along only two edges and terminating short of said lock-receiving openings.

4. A floor structure as defined in claim 1 wherein said plurality of floor sections have depending strengthening flanges extending normal to each other, and said support members have a pair of planar sections at generally right angles to each other whereby a support member is oriented in support position by engagement with a pair of said depending strengthening flanges.

5. A floor structure as defined in claim 2 wherein a plurality of said support members are preassembled into an integral unit and including interfitted channel members at right angles to each other and in overlapping relation at adjacent ends and one of said support members positioned beneath said overlapped ends and secured thereto as by welding and with means defining openings to coact with said floor section openings to receive said locking means.

6. A floor structure as defined in claim 5 wherein each of said channel members has a length equal to the length of a perimetric edge of each of said floor sections.

7. A floor structure as defined in claim 1 wherein said additional floor sections include a second section with three-fourths the area of the basic section, a third section with one-half the area of the basic section, and a fourth section with one-fourth the area of the basic section.

8. A floor structure as defined in claim 7 wherein said second and fourth sections have an edge which is approximately one-half said modular length.

9. A floor structure as defined in claim 7 wherein said second, third and fourth sections have at least one right angle corner and an edge opposite thereto which is inclined to the contiguous edges.

10. A floor structure as defined in claim 9 wherein second, third and fourth sections have a depending strengthening flange along said inclined edge.

11. A floor structure as defined in claim 9 wherein said second and fourth sections each include two types of section with a reversal in the direction of the inclined edge.

12. A floor structure of modular components for use in a round building comprising, four different planar floor sections with a basic planar section having a square contour and with all four edges of the same modular length and which in multiples provides the major area of the floor, a second of said planar sections having a triangular contour with one-half the area of said basic planar section and with the two base legs thereof being of said modular length, a third of said planar sections having a triangular contour with one-fourth the area of said basic planar section and with one base leg thereof being of said modular length, a fourth of said planar sections having three-fourths the area of said basic section and with two perimetric edges of said modular length, said basic planar section having two strengthening flanges depending from two adjacent edges thereof, said second, third and fourth planar sections each having an edge inclined to the contiguous edges thereof and with a strengthening flange depending from said inclined edge, and means for holding said planar floor sections in assembled relation with said inclined edges and depending strengthening flanges at the perimeter of the floor structure including fastener-receiving openings at the corners of said planar sections with adjacent floor sections having a planar edge portion of one floor section overlapped with a planar part of the adjacent floor section and with the uppermost floor section being free to overlap because of no strengthening flange depending from the edge which overlaps to place corner openings of two floor planar sections in coincident relation, support members positioned beneath overlapped parts of said floor sections and with openings aligned with said fastener-receiving openings, and fasteners extended through the coincident openings of said overlapped floor sections and support members.

13. A floor structure as defined in claim 12 wherein said support members each comprise a pair of integral vertical panels normal to each other to form a corner and with a plurality of strengthening flanges extended therefrom, certain of said strengthening flanges extending horizontally at right angles from said panels to define a ground-engaging foot, a plurality of said support members being oriented to have their vertical panels engaging said two strengthening flanges of the underlapped basic floor sections, and additional flanges at the opposite ends of said panels being overlapped at said corner and having one of said openings to receive one of said fasteners.

14. A floor structure as defined in claim 13 wherein a plurality of said support members are preassembled into an integral unit and including interfitted channel members at right angles to each other and in overlapping relation at adjacent ends and one of said support members positioned beneath said overlapped ends and secured thereto as by welding and with means defining openings to coact with said floor section openings to receive said fastening means, each of said channel members having a length equal to said modular length.

* * * * *